United States Patent [19]

Davis

[11] 4,295,498

[45] Oct. 20, 1981

[54] GRIPPER SHUTTLES

[75] Inventor: Charles D. Davis, Charlotte, N.C.

[73] Assignee: Armstrong World Industries, Inc., Lancaster, Pa.

[21] Appl. No.: 144,418

[22] Filed: Apr. 28, 1980

[51] Int. Cl.[3] ..... D03J 5/06

[52] U.S. Cl. ..... 139/196.2

[58] Field of Search ..... 139/439, 196.1, 196.2

[56] References Cited

U.S. PATENT DOCUMENTS

| | | | |
|---|---|---|---|
| 2,660,201 | 11/1953 | Darash | 139/196.2 |
| 3,237,653 | 3/1966 | Klein et al. | 139/196.2 |
| 3,853,152 | 12/1974 | Pfarrwaller | 139/196.2 |
| 3,854,506 | 12/1974 | Pfarrwaller | 139/196.2 |
| 3,939,878 | 2/1976 | Pfarrwaller | 139/196.2 |
| 4,120,329 | 10/1978 | Hintsch et al. | 139/196.2 |

*Primary Examiner*—Henry Jaudon

[57] ABSTRACT

An improved configuration for the nose portion of a gripper shuttle is disclosed. A recess, which may be a concave depression, is formed in the arcuate edge of the tapered front end portion of a tubular shuttle having a gripper clamp mounted therein with the weft gripping jaws positioned even with or in close proximity to the open trailing end thereof. The recess is so shaped and dimensioned as to preclude contact between the front edge of the shuttle with the weft gripping jaws of a similar shuttle when the front and rear ends of the shuttles contact each other in the same plane. Thus, in the event of a machine malfunction causing one shuttle to crash into the rear end of a preceding shuttle, the force of impact of one shuttle on another in this manner is borne by the body portions of the shuttles rather than being borne by the body portion of one of the shuttles and the gripper clamp of another.

3 Claims, 3 Drawing Figures

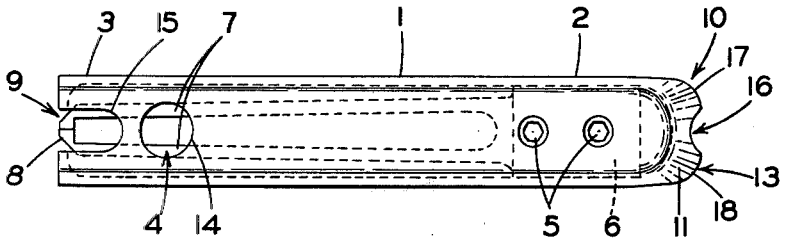
FIG. 1
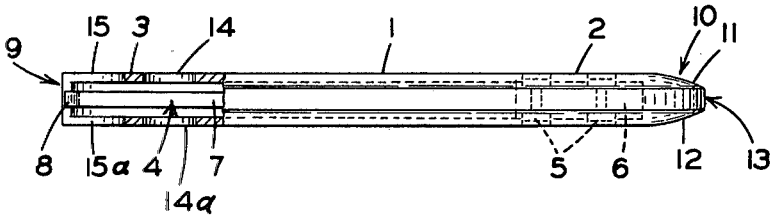
FIG. 2
FIG. 3
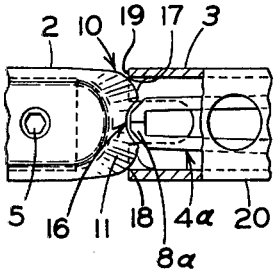

GRIPPER SHUTTLES

BACKGROUND OF THE INVENTION

1. Field of the Invention

This invention relates to an improvement in gripper shuttles of the type used in weaving machines wherein the weft package remains outside the shed. The invention is more particularly concerned with a modification of the nose portion of such shuttles.

2. Description of the Prior Art

The known gripper shuttles normally comprise a tubular housing within which is mounted a gripper clamp. The lead end of such shuttles have a closed nose portion and an open trailing end. Normally, the nose, at least, is made of metal, such as steel and may be an integral part of the housing or may be a separate part secured to the front of the housing by welding or in some other known manner. As a rule, the nose has top and bottom surfaces which slope downwardly and upwardly respectively toward the longitudinal axis of the shuttle, the front edge has a transverse arcuate configuration and is blunt and rounded to facilitate passage of the shuttle through the teeth of a shuttle race which serves as a guide for the shuttle in its flight. The gripper clamp is generally U-shaped and has two spaced resiliently biased arms extending toward the trailing end of the housing and culminating in jaws adjacent the opening therein. During operation, the gripper clamp is opened by introducing a wedge-shaped or conical gripper clamp opener at an appropriate place between the arms of the gripper clamp. A weft yarn end is then introduced between the opened jaws and the clamp opener removed, whereby the jaws grip the yarn and the shuttle is passed into the shed through the teeth of the shuttle guide. The shuttle is brought to a stop in a receiving unit, and returned to the picking position by a conveyer underneath the shed. A number of shuttles are used in each machine, so that they can be returned at moderate speeds despite the rapid picking sequence. In modern weaving machines, shooting speeds of up to something like 30 meters per second and picking rates of more than 300 picks per minute are used. Known shuttles of this type generally have standard dimensions of approximately $90\times14\times16$ millimeters and weigh about 30 to 60 grams.

U.S. Pat. No. 3,854,506 relates to a gripper shuttle wherein the shuttle housing is made of a tough impactresistant plastic while the gripper clamp and the nose at one end of the clamp are made of steel. The gripper clamp and the nose can be formed as a single unit. The shuttle housing is provided with a partition between the arms of the gripper clamp to reinforce and stiffen the housing. At least one of the clamp arms is provided with a thickened part to abut the partition when in the clamping position and thereby prevent premature wear of the arms.

U.S. Pat. No. 3,237,653 relates to a shuttle for looms comprising a housing having an open lead and then an open trailing end, a gripper spring in the housing, the gripper spring having an arcuate nose portion and a yoke portion. The arcuate nose portion is connected to the yoke portion from which spaced arms extend toward the trailing end of the housing and culminate in jaws adjacent the trailing end of the housing. Flange means connected to the housing extend over and partially close the opened trailing end to provide additional surface area to distribute the impact of the picker thereon.

U.S. Pat. No. 3,939,878 relates to a gripper shuttle for weft yarns. The shuttle is formed with a nose member which overlaps the front edges of the housing while being disposed within the projected plane of the housing. A gripper mechanism is mounted within the housing and has gripper jaws located adjacent the open end portion of the trailing end of the shuttle. The means for securing the nose member to the housing is in the form of a spigot which is received in the front end of the housing and which is integrally formed with the nose member. In addition, the securing means includes a pin which is disposed in bores of the spigot and housing to retain the spigot in the housing.

In the past, when the above-described shuttles were used in modern weaving machines at the speeds indicated, there have been times when the machines would jam or malfunction causing a shuttle to be retained in the receiving unit while another shuttle was being shot or picked through the shed. This resulted in the latter shuttle crashing into the rear of the preceding shuttle. Since the jaws of the gripper clamp in the preceding shuttle are located adjacent the open trailing end of the shuttle and since the nose portion of the shuttle crashing into it was shaped as described above, the arcuate nose portion of a second shuttle would strike the jaws of the gripper clamp of the preceding shuttle with sufficient force to cause breakage thereof. This, of course, resulted in extra expense, inconvenience, and loss of time. This is the problem overcome by the present invention.

SUMMARY OF THE INVENTION

This invention relates to an improvement in the configuration of the nose of a gripper shuttle for picking weft threads in a weaving machine. The shuttle comprises a tubular housing substantially oblong in transverse cross-section and having a closed front end and an open trailing end. A gripper clamp is mounted within the housing and includes having means positioned even with or in close proximity to the opening in the trailing end of the housing for gripping a weft thread. The improvement comprises an arcuate front end edge surface with a centrally located recess therein, the recess being so shaped and dimensioned as to preclude contact between the front end edge surface of the shuttle and the weft thread gripping means of a similar shuttle when the front and rear ends of the shuttles contact each other in the same plane. The distance between the edges of the recess on the arcuate end edge surface of the housing is less than the distance between the inner edges of the open end of the housing of the shuttles whereby, upon the impact of the front end of one shuttle upon the rear end of a similar shuttle in the same plane, the force of the impact is borne only by the rear housing of the shuttle struck. This eliminates the problem of gripper clamps being broken when there is a malfunction in the weaving machine and one shuttle crashes into another.

BRIEF DESCRIPTION OF THE DRAWINGS

FIG. 1 is a top plan view of a gripper shuttle showing the improved configuration of the nose portion thereof;

FIG. 2 is a side elevational view of the shuttle of FIG. 1;

FIG. 3 is a plan view showing a portion of the nose of the shuttle of FIG. 1 in contact with the rear end portion (partially in section) of a similar gripper shuttle.

DESCRIPTION OF THE PREFERRED EMBODIMENT

Referring to FIGS. 1 and 2, there is shown a gripper shuttle havng a main body portion 1 with a front end 2 and a trailing end 3. A gripper clamp 4 is mounted in the housing 1 and secured therein by fastening means 5 passing through a yoke portion 6. Extending from the yoke 6 toward the trailing end 3 of the housing 1 is a pair of spaced resiliently biased arms 7 which culminate in jaws 8 adjacent the opening 9 in the trailing end 3 of the shuttle. As shown in the drawings, the nose portion 10 on the front end 2 of the housing 1 has top and bottom surface 11 and 12 which slope downwardly and upwardly respectively toward the longitudinal axis of the shuttle. The front edge 13 of the nose 10 has a normally transverse arcuate configuration and is blunt and rounded, all to facilitate passage of the shuttle through the teeth of a shuttle race (not shown) which serves as a guide for the shuttle in flight. Openings 14 and 14*a* are provided in the top and bottom of the housing 1 to permit the introduction of a jaw actuating member from the loom to bear against the arms 7 to open the jaws 8 of the gripper clamp 4 for the insertion of a fill yarn. Openings 15 and 15*a* are also provided in the top and bottom of the housing 1 to allow the fill yarn from the loom to be inserted between the jaws 8 of the gripper clamp 4.

As shown in the drawings, the housing 1 or body of the shuttle, including the nose portion 10, may be formed as a unit. However, as is known in the prior art, the shuttle may be formed in a variety of ways. The nose, as a rule, is a solid metal item, such as steel and may be formed separately from the housing and attached thereto in a known manner such as by welding, if the housing is also metal, or by riveting. The nose and gripper clamp can also be formed as a single unit, and the shuttle housing may be made of light, tough plastic such as polyethylene or tetrafluoroethylene, an aluminum alloy, or a sintered material. The specific construction of the shuttle, however, other than the modification of the nose portion thereof forms no part of the present invention and no claim is made thereto.

As shown in FIGS. 1 and 3, the concave recess 16 formed in the front edge 13 of the nose 10 of the shuttle is centrally located, and its depth and greatest transverse dimension as best seen in FIG. 3, are such that when the edge portions 17 and 18 of the nose 10 are in contact with the rear edge 19 of another shuttle 20, the nose 10 does not contact the jaws 8*a* of the gripper clamp 4*a* in shuttle 20. Obviously, this deceptively simple modification of the nose of the shuttle very effectively overcomes the problem and expense accompanying the breakage of gripper clamps previously experienced when one shuttle collided with the rear end of another when a jam-up occurred on the shuttle-receiving side of the weaving machine. Further, the modification of the nose of the shuttle, as disclosed by this invention, does not in any way detract from the desirable features of the usual nose configurations of the shuttles which facilitate passage of the shuttle through the teeth which usually form a guide for the shuttle and facilitate its entry into the normal shuttle brake on the catching side of the machine.

While the concave configuration of the depression in the nose of the shuttle is the preferred shape, obviously other depression shapes could be substituted therefor, as would occur to one skilled in the art after becoming aware of the disclosure of this invention.

What is claimed is:

1. In a gripper shuttle for picking weft threads in a weaving machine, said shuttle comprising a tubular housing substantially oblong in transverse cross-section and having a closed front end and an open trailing end, a gripper clamp mounted within said housing and having means positioned even with or in close proximity to the opening in the trailing end of said housing for gripping a weft thread, the improvement comprising a nose on said housing having an arcuate front end edge surface with a centrally located recess therein, said recess being so dimensioned as to preclude contact between the front end edge surface of said shuttle and the weft thread gripping means of a similar shuttle when the front and rear ends of the shuttles contact each other in the same plane.

2. The improvement in the front end configuration of a gripper shuttle according to claim 1 wherein the nose on the shuttle housing has top and bottom surfaces which slope downwardly and upwardly respectively toward the longitudinal axis of the shuttle and wherein the distance between the edges of the recess on the arcuate end edge surface of the housing is less than the distance between the inner edges of the open end of the housing whereby upon impact of the front end of the shuttle upon the rear end of a similar shuttle in the same plane, the force of the impact will be borne only by the rear end of the housing of the shuttle being struck.

3. The improvement in the front end configuration of a gripper shuttle according to claim 2 wherein the recess on the arcuate end edge surface of the nose on the housing comprises a concave depression.

* * * * *